US009780445B2

(12) United States Patent
Hwang et al.

(10) Patent No.: US 9,780,445 B2
(45) Date of Patent: Oct. 3, 2017

(54) ANTENNA ASSEMBLY WITH HIGH ISOLATION

(71) Applicant: HON HAI PRECISION INDUSTRY CO., LTD., New Taipei (TW)

(72) Inventors: Tzu-Yao Hwang, New Taipei (TW); Lung-Sheng Tai, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 475 days.

(21) Appl. No.: 14/477,892

(22) Filed: Sep. 5, 2014

(65) Prior Publication Data

US 2015/0070237 A1 Mar. 12, 2015

(30) Foreign Application Priority Data

Sep. 9, 2013 (TW) ..... 102132333

(51) Int. Cl.

| | |
|---|---|
| ***H01Q 1/48*** | (2006.01) |
| ***H01Q 1/52*** | (2006.01) |
| ***H01Q 1/24*** | (2006.01) |
| ***H01Q 9/06*** | (2006.01) |

(52) U.S. Cl.

CPC ..... *H01Q 1/526* (2013.01); *H01Q 1/243* (2013.01); *H01Q 1/48* (2013.01); *H01Q 9/065* (2013.01)

(58) Field of Classification Search

CPC ..... H01Q 1/48; H01Q 1/243; H01Q 1/526
USPC ..... 343/841
See application file for complete search history.

(56) References Cited

U.S. PATENT DOCUMENTS

| | | | | |
|---|---|---|---|---|
| 6,404,394 | B1 | 6/2002 | Hill | |
| 2012/0038520 | A1* | 2/2012 | Cornwell | H01Q 1/24 343/702 |
| 2012/0105296 | A1* | 5/2012 | Chung | H01Q 1/243 343/842 |
| 2012/0319916 | A1* | 12/2012 | Gears | H01Q 1/525 343/841 |
| 2013/0050031 | A1 | 2/2013 | Zhu et al. | |

FOREIGN PATENT DOCUMENTS

| | | |
|---|---|---|
| CN | 101872897 A | 10/2010 |
| CN | 103219589 A | 7/2013 |
| TW | M270511 | 7/2005 |
| TW | 200803035 | 1/2008 |
| TW | 201316613 A | 4/2013 |

* cited by examiner

*Primary Examiner* — Dameon E Levi
*Assistant Examiner* — Andrea Lindgren Baltzell
(74) *Attorney, Agent, or Firm* — Wei Te Chung; Ming Chieh Chang

(57) ABSTRACT

An antenna assembly includes a main body, a coaxial cable connecting the main body and an isolating member located beside the main body. The main body includes a grounding portion extending in a longitudinal direction, a radiating portion extending in the longitudinal direction and a connecting portion connecting the grounding portion and the radiating portion. The coaxial cable includes an inner conductor connecting the connecting portion and an outer conductor surrounding the inner conductor and connecting the grounding portion. The isolating member located beside the main body in a side by side manner and defined a gap therebetween.

19 Claims, 6 Drawing Sheets

ANTENNA ASSEMBLY WITH HIGH ISOLATION

BACKGROUND OF THE INVENTION

1. Field of the Invention

The present disclosure relates to an antenna assembly, and more particularly to a high isolation antenna assembly.

2. Description of Related Art

With the development of technology, more and more portable electronic devices are equipped with wireless transceiver for transmitting wireless signals, so antenna is integrated therein. In order to meet the wireless signal transmission on different frequency band, the portable electronic equipment is often integrated with two or more antennas. However, with the miniaturization tendency of portable electronic devices, the internal space of the electronic device becomes smaller and smaller and the distance between two antennas becomes closer and closer. Thus the isolation therebetween becomes bad and can not meet the normal requirement of each antenna.

In view of the above, an improved antenna assembly is desired to overcome the problems mentioned above.

SUMMARY OF THE INVENTION

Accordingly, an object of the present disclosure is to provide an antenna assembly with high isolation.

According to one aspect of the present disclosure, an antenna assembly with an isolating member is provided. The antenna assembly includes a main body, a coaxial cable connecting the main body and an isolating member located beside the main body. The main body includes a grounding portion extending in a longitudinal direction, a radiating portion extending in the longitudinal direction and a connecting portion connecting the grounding portion and the radiating portion. The coaxial cable includes an inner conductor connecting the connecting portion and an outer conductor surrounding the inner conductor and connecting the grounding portion. The isolating member located beside the main body in a side by side manner and defined a gap therebetween.

Other objects, advantages and novel features of the disclosure will become more apparent from the following detailed description when taken in conjunction with the accompanying drawings, in which:

DETAILED DESCRIPTION OF THE INVENTION

Reference will now be made to the drawings to describe a preferred embodiment of the present disclosure in detail.

Figure 1:
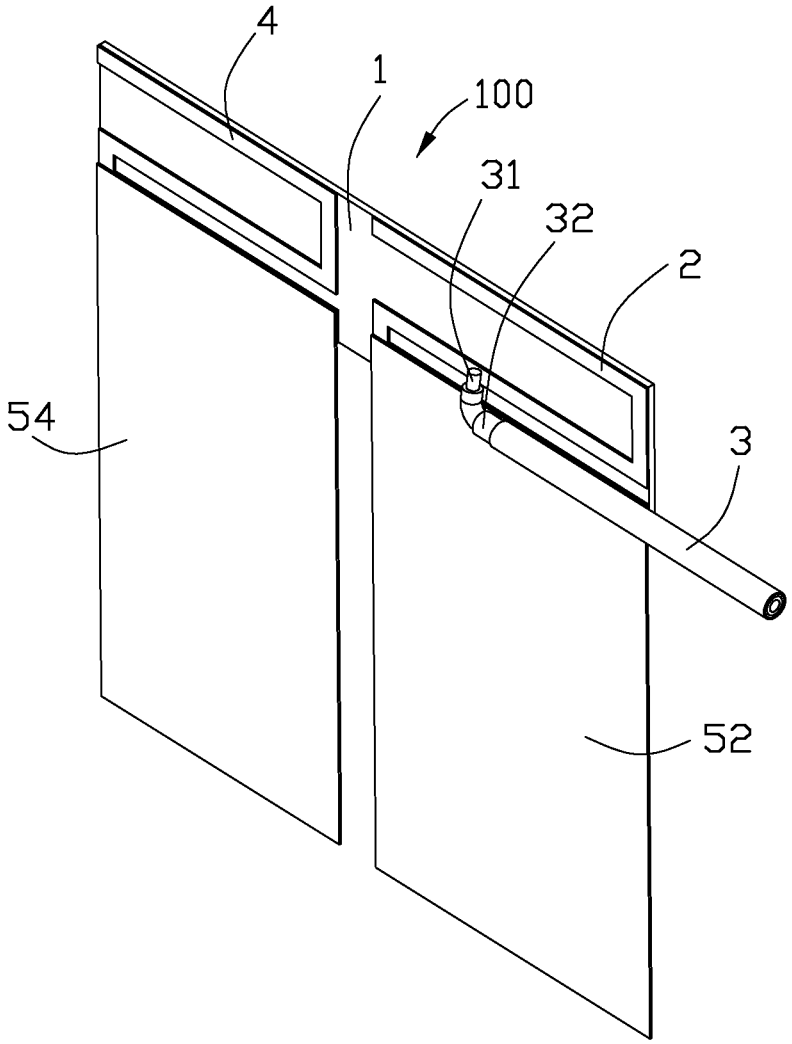
FIG. 1 is an assembled, perspective view of an antenna assembly in accordance with a preferred embodiment of the present disclosure.

Referring to FIG. 1, an antenna assembly 100 comprises a substrate 1, a main body 2 defined on the substrate 1, an isolating member 4 defined on the substrate 1, a coaxial cable 3 connecting the main body 2 and metal foils 52, 54 connecting the main body 2 and the isolating member 4 respectively. The coaxial cable 3 comprises an inner conductor 31 and an outer conductor 32 surrounding the inner conductor 31.

Figure 2:
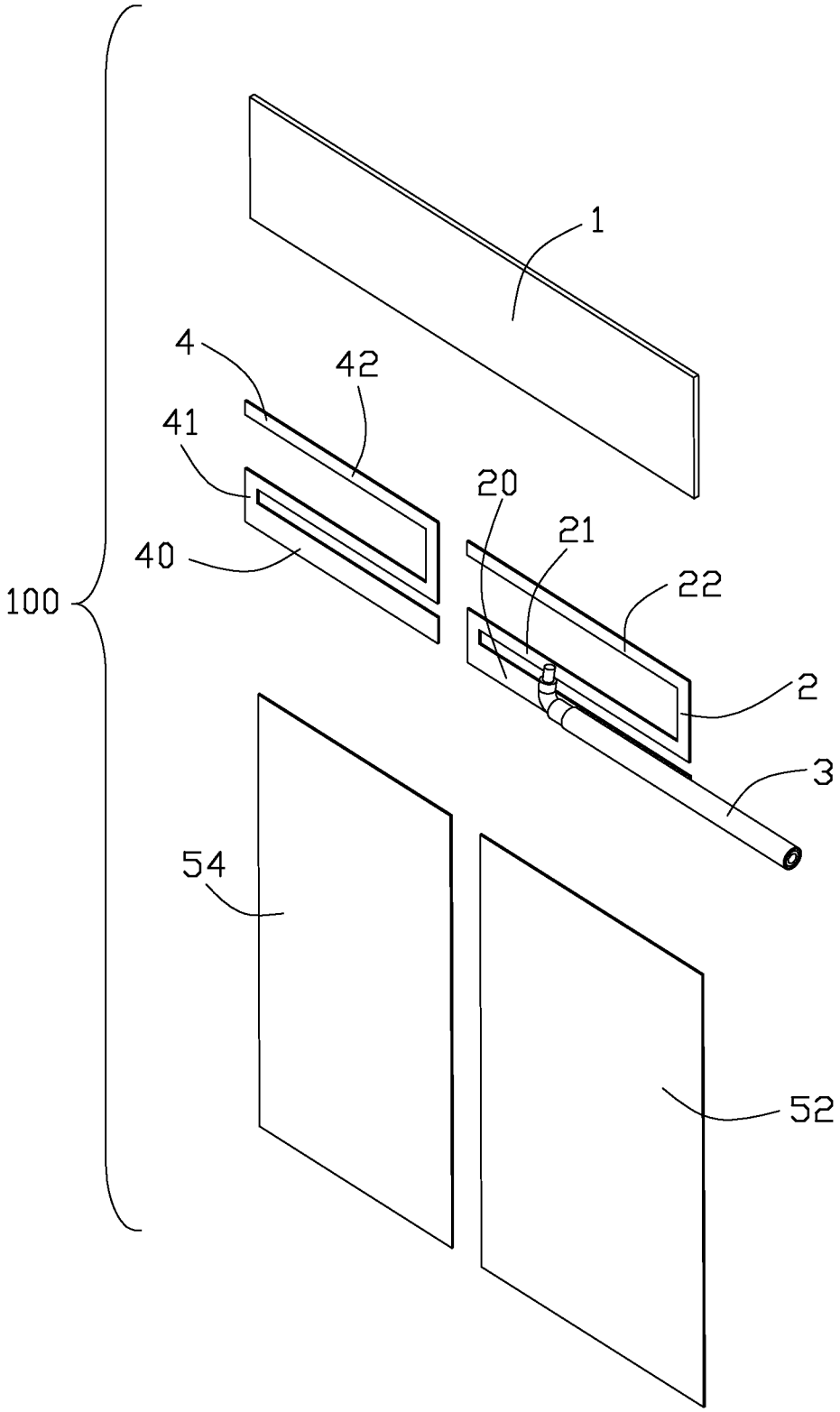
FIG. 2 is an exploded, perspective view of the antenna assembly shown in FIG. 1.

Referring to FIG. 2, the substrate 1 is rectangular and extends in a longitudinal direction. The main body 2 comprises a grounding portion 20 extending in the longitudinal direction, a radiating portion 22 and a connecting portion 21 connecting the grounding portion 20 and the radiating portion 22. The connecting portion 21 comprises a vertical section extending in a vertical direction perpendicular to the longitudinal direction from one end of the grounding portion 20 and a lengthwise section extending from the vertical section and extending in the longitudinal direction. The lengthwise section and the grounding portion 20 define a slot therebetween. The radiating portion 22 is L-shaped, comprising a first section extending in the vertical section from one end of the lengthwise section of the connecting portion 21 and a second section extending in the longitudinal direction backwardly. The radiating portion 22 and the lengthwise section of the connecting portion 21 define a U shape facing the isolating member 4 while the connecting portion 21 and the grounding portion 20 define another U shape facing opposite to the isolating member 4. The main body 2 wholly is substantially configured with an inverted-S configuration.

The inner conductor 31 of the coaxial cable 2 connects the lengthwise direction of the connecting portion 21 forming a signal feed point while the outer conductor 32 connects the grounding portion 20 forming a grounding point.

The isolating member 4 substantially has the same configuration and orientation with the main body 2 along the longitudinal direction. The isolating member 4 comprises an isolating grounding portion 40, a linking portion 41 extending from one end of the isolating grounding portion 40 and an arm portion 42 configured with U shape facing opposite the main body 2. The isolating member 4 locates beside the main body 2 in a side-by-side manner and defining a gap therebetween. The dimension of the isolating member 4 is the same with that of the main body 2 in the vertical direction while the dimension of the isolating member 4 is less than that of the main body 2 in the longitudinal direction. The isolating member 4 and the main body 2 wholly is configured with the shape of "22". The metal foil 52, 54 is pasted on the mail body 2 and the isolating member 4 and separated from each other.

Figure 3:
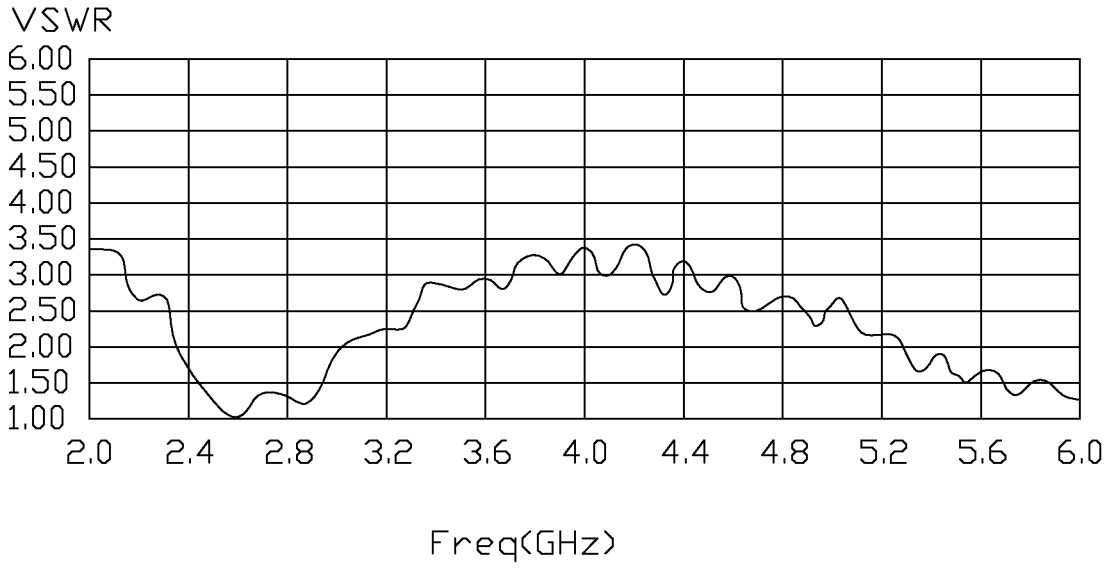
FIG. 3 is a Voltage Standing Wave Ratio (VSWR) chart of the antenna assembly with an isolating member shown in FIG. 1.
Figure 4:
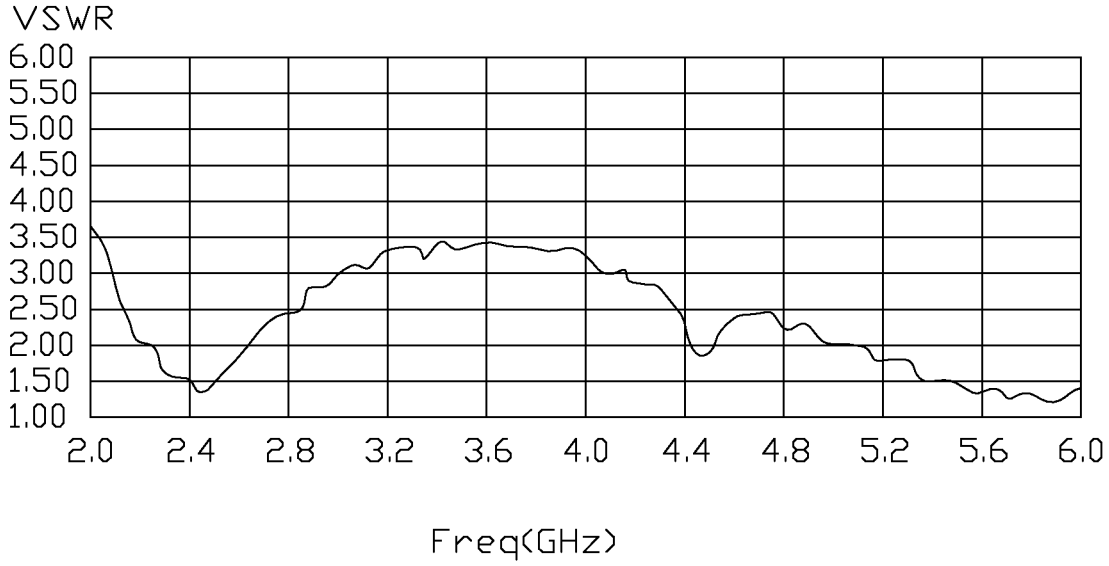
FIG. 4 is a VSWR chart of the antenna assembly without the isolating member.
Figure 5:
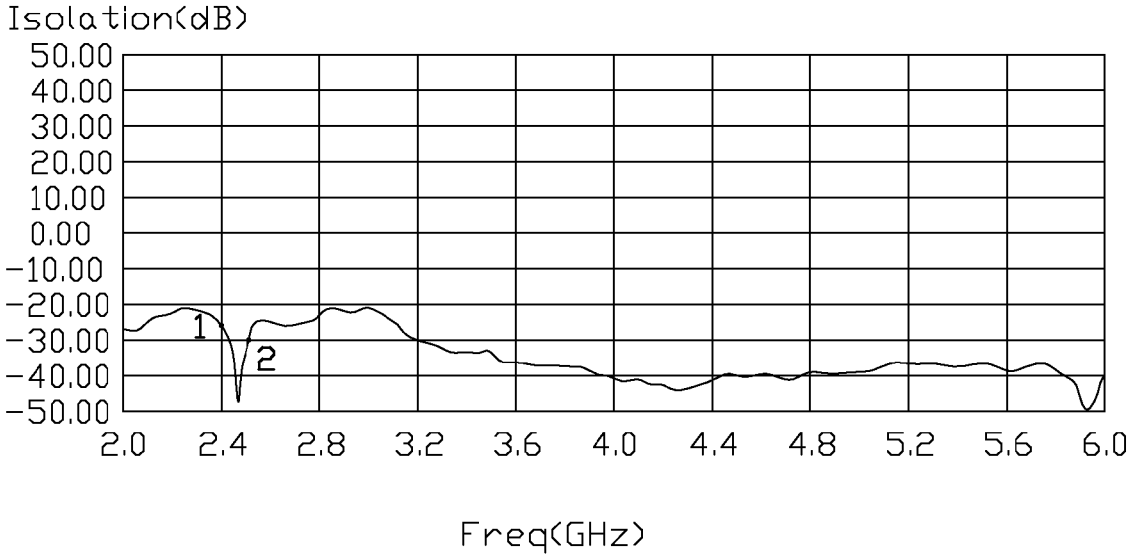
FIG. 5 is an isolation chart of the antenna assembly with an isolating member shown in FIG. 1.
Figure 6:
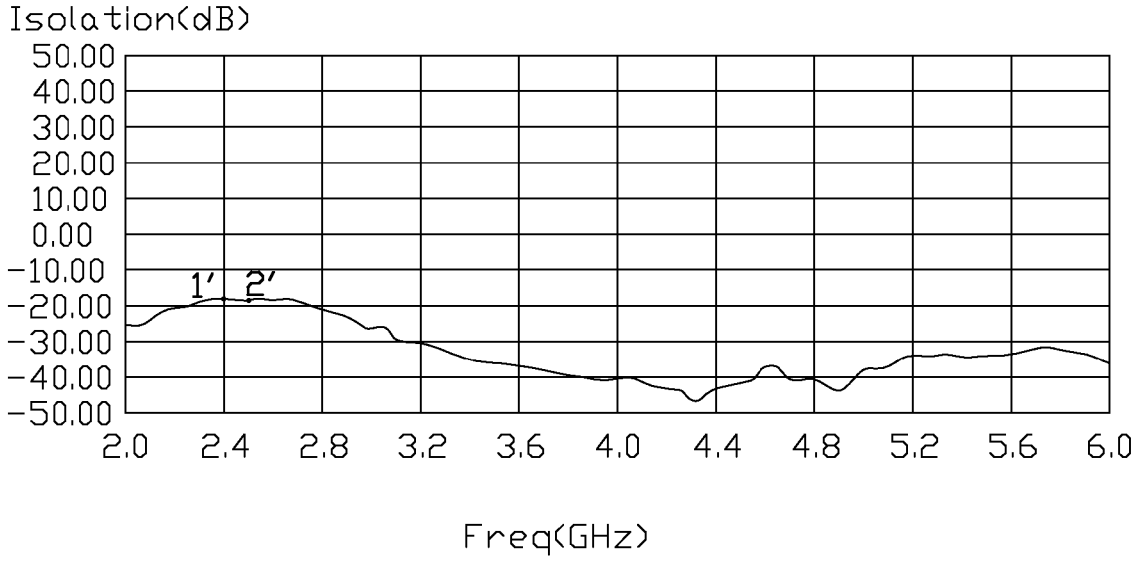
FIG. 6 is an isolation chart of the antenna assembly without the isolating member.

As show in FIGS. 3 and 4, the frequency bands of the antenna assembly 100 are 2.4-2.5 GHz and 5.15-5.85 GHz. FIG. 5 shows the isolation chart of the present antenna assembly 100. Referring to point numbered 1, wherein the frequency is 2.4 GHz, the isolation is −26 dB; referring to point numbered 2, wherein the frequency is 2.5 GHz, the isolation is −30 dB. The antenna assembly 100 of the present disclosure performs a high isolation. FIG. 6 is a comparison chart without the isolating member 4. As the points numbered as 1' and 2' show, when the frequency band is 2.4-2.5 GHz, the isolation is about −17 dB, the isolation is bad.

While preferred embodiment in accordance with the present disclosure has been shown and described, equivalent modifications and changes known to persons skilled in the art according to the spirit of the present disclosure are considered within the scope of the present disclosure as defined in the appended claims.

What is claimed is:

1. An antenna assembly comprising:

a main body comprising a grounding portion extending in a longitudinal direction, a radiating portion extending in the longitudinal direction and a connecting portion connecting the grounding portion and the radiating portion;

a coaxial cable comprising an inner conductor connecting the connecting portion and an outer conductor surrounding the inner conductor and connecting the grounding portion; and an isolating member located beside the main body in a side by side manner and defined a gap therebetween; wherein the isolating member substantially has the same configuration and orientation with the main body along the longitudinal direction.

2. The antenna assembly as claimed in claim 1, wherein the isolating member comprises a U-shaped arm portion, the opening of said U-shaped arm portion faces opposite to the main body.

3. The antenna assembly as claimed in claim 2, wherein the isolating member comprises an isolating grounding portion extending in the longitudinal direction and connecting with the arm portion through a linking portion.

4. The antenna assembly as claimed in claim 3, wherein the antenna assembly comprises metal foils assembled on the isolating grounding portion of the isolating member and the grounding portion of the main body respectively.

5. The antenna assembly as claimed in claim 2, wherein the connecting portion comprises a vertical section connecting the grounding portion and extending in a vertical direction perpendicular to the longitudinal direction and a lengthwise section extending from the vertical direction in the longitudinal direction.

6. The antenna assembly as claimed in claim 5, wherein the radiating portion is L-shaped firstly extending from one end of the lengthwise section in the vertical direction and then extending in the longitudinal direction, the radiating portion together with the lengthwise section defines another U shape facing towards the isolating member.

7. The antenna assembly as claimed in claim 1, wherein the isolating member and the main body are coplanar, the dimension of the isolating member in a vertical direction perpendicular to the longitudinal direction is same with that of the main body.

8. The antenna assembly as claimed in claim 7, wherein the dimension of the isolating member in the longitudinal direction is less than that of the main body.

9. The antenna assembly as claimed in claim 1, wherein another antenna is defined beside the main body and separated by the isolating member.

10. An antenna comprising:

a first structure including:

a grounding portion extending along a longitudinal direction;

a radiating portion spaced from the grounding portion in a vertical direction perpendicular to said longitudinal direction, and in a parallel relation;

a connecting portion linked between the grounding portion and the radiating portion;

a feeder cable including an inner conductor mechanically and electrically connected to the connecting portion; and a second structure having a similar configuration and a same orientation with the first structure along the longitudinal direction except without the feeder cable, being side by side located beside the first structure.

11. The antenna as claimed in claim 10, wherein the second structure is smaller than the first structure in the longitudinal direction.

12. The antenna as claimed in claim 10, wherein the first structure and the second structure have a same dimension in the vertical direction.

13. The antenna as claimed in claim 10, wherein each of said first structure and said second structure has a metallic foil attached to the corresponding grounding portion opposite to the corresponding connecting portion and radiating portion in the vertical direction.

14. The antenna as claimed in claim 13, wherein a dimension of the metallic foil of the second structure along the longitudinal direction is smaller than that of the first structure along the longitudinal direction.

15. The antenna as claimed in claim 10, wherein the connecting portion defines a Z like configuration with two opposite ends respectively connected to opposite ends of said grounding portion and said radiating portion in said longitudinal direction.

16. The antenna as claimed in claim 15, wherein the connecting portion forms a horizontal section parallel to both said grounding portion and said radiating portion, to which said inner connector is mechanically and electrically connected.

17. The antenna as claimed in claim 10, wherein the radiating portion and the connecting portion of the first structure commonly define an opening facing toward the second structure.

18. An antenna comprising:

a first planar structure defining a first upstanding "2" like configuration;

a second planar structure a second upstanding "2" like configuration similar to the first upstanding "2" like configuration, said first planar structure and said second planar structure being closely side by side arranged with each other along a longitudinal direction, and said second planar structure being by one side of said first planar structure facing an opening of said first planar structure in the longitudinal direction, said first planar structure and said second planar structure having a same orientation in the longitudinal direction; and the first planar structure being equipped with a feeder cable while the second planar structure not; wherein a dimension of the second planar structure is less than that of the first planar structure in the longitudinal direction.

19. The antenna as claimed in claim 18, wherein the first planar structure is equipped with a first metallic foil and the second planar structure is equipped with a second metallic foil which is dimensioned smaller than the first metallic foil in the longitudinal direction.

* * * * *